US009567546B2

(12) United States Patent
Komatsubara

(10) Patent No.: US 9,567,546 B2
(45) Date of Patent: Feb. 14, 2017

(54) LUBRICATING OIL COMPOSITION

(71) Applicant: JX Nippon Oil & Energy Corporation, Tokyo (JP)

(72) Inventor: Hitoshi Komatsubara, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 14/655,225

(22) PCT Filed: Aug. 27, 2013

(86) PCT No.: PCT/JP2013/072832
§ 371 (c)(1),
(2) Date: Jun. 24, 2015

(87) PCT Pub. No.: WO2014/103426
PCT Pub. Date: Jul. 3, 2014

(65) Prior Publication Data

US 2015/0353859 A1 Dec. 10, 2015

(30) Foreign Application Priority Data

Dec. 28, 2012 (JP) ..... 2012-288289

(51) Int. Cl.
*C10M 141/08* (2006.01)
*C10M 169/04* (2006.01)

(52) U.S. Cl.
CPC ..... *C10M 141/08* (2013.01); *C10M 169/04* (2013.01); *C10M 2203/1006* (2013.01); *C10M 2203/1025* (2013.01); *C10M 2209/084* (2013.01); *C10M 2215/28* (2013.01); *C10M 2219/068* (2013.01); *C10M 2227/066* (2013.01); *C10N 2210/06* (2013.01); *C10N 2220/022* (2013.01); *C10N 2230/02* (2013.01); *C10N 2230/06* (2013.01); *C10N 2230/43* (2013.01); *C10N 2230/54* (2013.01); *C10N 2240/04* (2013.01); *C10N 2260/14* (2013.01)

(58) Field of Classification Search
CPC ..... C10M 141/08; C10M 169/04; C10M 2203/1006; C10M 2203/1025; C10M 2209/084; C10M 2215/28; C10M 2219/068; C10M 2227/066; C10N 2210/06; C10N 2220/022; C10N 2230/06; C10N 2230/43; C10N 2230/54; C10N 2240/04; C10N 2230/02; C10N 2260/14
See application file for complete search history.

(56) References Cited

U.S. PATENT DOCUMENTS

| | | | | |
|---|---|---|---|---|
| 6,245,725 | B1 * | 6/2001 | Tanaka | C10M 141/08 508/363 |
| 2006/0135378 | A1 * | 6/2006 | Takahashi | C10M 169/04 508/433 |
| 2011/0065618 | A1 | 3/2011 | Tagawa | |

FOREIGN PATENT DOCUMENTS

| | | | |
|---|---|---|---|
| JP | H03-39399 | A | 2/1991 |
| JP | H07-268375 | A | 10/1995 |
| JP | 09-208976 | A | 8/1997 |
| JP | 2000-063869 | A | 2/2000 |
| JP | 2009-227928 | A | 10/2009 |
| JP | 2011-006635 | A | 1/2011 |
| JP | 2011-046903 | A | 3/2011 |
| JP | 2012-046683 | A | 3/2012 |

OTHER PUBLICATIONS

International Search Report issued Nov. 19, 2013 in International Application No. PCT/JP2013/072832.

* cited by examiner

*Primary Examiner* — Cephia D Toomer
(74) *Attorney, Agent, or Firm* — Panitch Schwarze Belisario & Nadel LLP

(57) ABSTRACT

The present invention provides a lubricating oil composition having fuel saving properties and providing gears and bearings with satisfactory durability, which is thus suitably used particularly for a gear system of an automobile. The lubricating oil composition a lubricating base oil comprising a mix base oil of (A) a mineral base oil having a 40° C. kinematic viscosity of 10 $mm^2/s$ or higher and 100 $mm^2/s$ or lower and (E) a mineral base oil having a 40° C. kinematic viscosity of 200 $mm^2/s$ or higher and 600 $mm^2/s$ or lower and a sulfur content of 0.3 to 0.9 percent by mass, the content of the base oil belonging to Component (B) is 15 percent by mass or more, and (C) and an organic molybdenum compound in an amount of 100 to 1000 ppm by mass as molybdenum, the lubricating oil composition having a 40° C. kinematic viscosity of 90 $mm^2/s$ or lower.

4 Claims, No Drawings

LUBRICATING OIL COMPOSITION

CROSS-REFERENCE TO RELATED APPLICATION

This application is a Section 371 of International Application No. PCT/JP2013/072832, filed Aug. 27, 2013, which was published in the Japanese language on Jul. 3, 2014, under International Publication No. WO 2014/103426 A1, and the disclosure of which is incorporated herein by reference.

TECHNICAL FIELD

The present invention relates to lubricating oil compositions, particularly to lubricating oil compositions for automobile gear systems and more particularly to lubricating oil compositions for final reduction gears equipped a hypoid gear mounted in automobiles.

BACKGROUND ART

Recently, energy saving in automobiles and construction or agricultural machinery, i.e., fuel saving has become an urgent need in order to deal with environmental, issues such as reduction in carbon dioxide emissions, and units such as engines, transmissions, final reduction gears, compressors, or hydraulic power units have been strongly demanded to contribute to energy saving. Consequently, the lubricating oils used in these units are required to be reduced in stir resistance and frictional resistance more than before.

Reduction of the viscosity of a lubricating oil is exemplified as an effective energy saving means. For example, an automobile automatic transmission or continuously variable transmission has a torque converter, a wet clutch, a gear bearing mechanism, an oil pump and a hydraulic control system while a manual transmission or final reduction gear unit has a gear bearing mechanism. Reduction of the viscosity of a lubricating oil to be used in such transmissions can reduce the stir and frictional resistances in the gear bearing mechanism and oil pump and thus enhance the power transmission efficiency, resulting in an improvement in the fuel efficiency of an automobile.

However, reduction of the viscosity of the lubricating oil used in these transmissions and units may cause the above-described units and mechanisms thereof to be significantly shortened in fatigue life or reduced in extreme pressure properties and may generate seizure, possibly resulting in some malfunctions in the transmissions or final reduction gear units.

Examples of conventional automobile transmission oils which enable a transmission to maintain various properties thereof such as shifting properties for a long time include those produced by optimizing and blending synthetic and/or mineral base oils, antiwear agents, extreme pressure additives, metafile detergents, ashless dispersants, friction modifiers and viscosity index improvers (for example, see Patent Literature Nos. 1 to 3 below).

However, since these compositions are all are not intended to improve fuel, economy, they are high in kinematic viscosity and have not been sufficiently studied with regard to effects on extreme pressure properties or metal-to-metal friction when lowered in viscosity.

CITATION LIST

Patent Literature

Patent Literature 1: Japanese Patent Application Laid-Open Publication No. 3-39399

Patent Literature 2: Japanese Patent Application Laid-Open Publication No. 7-268375

Patent Literature 3: Japanese Patent Application Laid-Open Publication No. 2000-63869

SUMMARY OF INVENTION

Technical Problem

The present invention has been made in view of these circumstances and has an object to provide a lubricating oil composition which has sufficient extreme pressure properties and a low metal-to-metal friction coefficient even having a low viscosity, particularly a lubricating oil composition which has both fuel saving properties and sufficient extreme pressure properties for gears bearings, suitable for automatic transmissions, manual transmissions and, continuously variable transmissions, particularly for final reduction gears equipped with a hypoid gear.

Solution to Problem

As the results of extensive studies carried out to achieve the above object, the present invention has been accomplished on the basis of the finding that the above object can be achieved with a lubricating oil composition comprising a specific low viscosity lubricating base oil and a specific nigh viscosity lubricating base oil in combination and an organic molybdenum compound blended in a specific amount.

That is, the present invention relates to a lubricating oil composition comprising a lubricating base oil comprising a mix base oil of (A) a mineral base oil having a 40° C. kinematic viscosity of 10 $mm^2/s$ or higher and 100 $mm^2/s$ or lower and (B) a mineral base oil having a 40° C. kinematic viscosity of 200 $mm^2/s$ or higher and 600 $mm^2/s$ or lower and a sulfur content of 0.3 to 0.9 percent by mass, the content of the base oil belonging to Component (B) is 15 percent by mass or more, and (C) an organic molybdenum compound in an amount of 100 to 1000 ppm by mass as molybdenum, the lubricating oil composition having a 40° C. kinematic viscosity of 90 $mm^2/s$ or lower.

The present invention also relates to the foregoing lubricating oil composition further comprising (D) a boron-containing compound in an amount of 100 to 300 ppm by mass as boron.

The present invention also relates to the foregoing lubricating oil composition wherein (D) the boron-containing compound is a metallic detergent over/based with a borate or a boronated ashless dispersant.

The present invention also relates to a method for lubricating an automobile gear system using a lubricating oil composition comprising a lubricating base oil comprising a mix base oil of (A) a mineral base oil having a 40° C. kinematic viscosity of 10 $mm^2/s$ or higher and 100 $mm^2/s$ or lower and (B) a mineral base oil having a 40° C. kinematic viscosity of 200 $mm^2/s$ or higher and 600 $mm^2/s$ or lower and a sulfur content of 0.3 to 0.9 percent by mass, the content of the base oil belonging to Component (E) is 15 percent by mass or more, and (C) and an organic molybdenum compound in an amount of 100 to 1000 ppm by mass as molybdenum; the lubricating oil composition having a 40° C. kinematic viscosity of 90 $mm^2/s$ or lower.

Advantageous Effect of Invention

The present invention provides a lubricating oil composition which has both fuel saving properties and sufficient extreme pressure properties for gears or bearings, suitable for automatic transmissions, manual transmissions and, continuously variable transmissions, particularly for final reduction gears equipped with a hypoid gear. The present invention also provides a method for lubricating an automobile gear system using the lubricating oil composition to improve the fuel saving properties and extreme pressure properties.

DESCRIPTION OF EMBODIMENTS

The present invention will be described below.

Component (A), i.e., base oil used in the present invention is one or more base oils selected from mineral lubricating base oils having a 40° C. kinematic viscosity of 10 $mm^2/s$ or higher and 100 $mm^2/s$ or lower.

Examples of the mineral lubricating base oil which may be used in the present invention include paraffinic or naphthenic mineral base oils which can be produced by subjecting a lubricating oil fraction produced by atmospheric- or vacuum-distillation of a crude oil, to any one of or any suitable combination of refining processes selected from solvent deasphalting, solvent extraction, hydrocracking, solvent dewaxing, catalytic dewaxing, hydrorefining, sulfuric acid treatment, and clay treatment; n-paraffins; and isoparaffins.

These base oils may be used alone or in combination at an arbitrary ratio.

Examples of preferred mineral lubricating base oil include the following base oils:

(1) a distillate oil produced by atmospheric distillation of a paraffin base crude oil and/or a mixed base crude oil;

(2) a whole vacuum gas oil (WVGO) produced by vacuum distillation of the topped crude of a paraffin base crude oil and/or a mixed base crude oil;

(3) a wax produced by a lubricating oil dewaxing process and/or a Fischer-Tropsch wax produced by a GTL process;

(4) an oil produced by mild-hydrocracking (MHC) one or more oils selected from oils of (1) to (3) above;

(5) a mixed oil of two or more oils selected from (1) to (4) above;

(6) a deasphalted oil (DAO) produced by deasphalting an oil of (1), (2) (3), (4) or (5);

(7) an oil produced by mild-hydrocracking (MHC) an oil of (6); and (8) a lubricating oil produced by subjecting a mixed oil of two or more oils selected from (1) to (7) used as a feed stock and/or a lubricating oil fraction recovered therefrom to a normal refining process and further recovering a lubricating oil fraction from the refined product.

No particular limitation is imposed on the normal refining process used herein. Therefore, there may be used any refining process having been conventionally used upon production of a lubricating base oil. Examples of the normal refining process include (a) hydro-refining processes such as hydrocracking and hydrofinishing, (b) solvent refining such as furfural extraction, (c) dewaxing such as solvent dewaxing and catalytic dewaxing, (d) clay refining with acidic clay or active clay and (e) chemical (acid or alkali) refining such as sulfuric acid treatment and sodium hydroxide treatment. In the present in vent ion, any one or more of these refining processes may be used in any combination and order.

The lower limit 40° C. kinematic viscosity of Component (A) that is a lubricating base oil used in the present invention is 10 $mm^2/s$ or higher, preferably 15 $mm^2/s$ or higher, more preferably 20 $mm^2/s$ or higher. The upper limit is 100 $mm^2/s$ or lower, preferably 75 $mm^2/s$ or lower, more preferably 50 $mm^2/s$ or lower, more preferably 40 mm/s or lower, most preferably 35 $mm^2/s$ or lower.

The use of a lubricating base oil with a 40° C. kinematic viscosity of 100 $mm^2/s$ or lower renders it possible to produce a lubricating oil composition having a smaller frictional resistance at lubricating sites because of its small fluid resistance. The use of a lubricating base oil with a 40° C. kinematic viscosity of 10 $mm^2/s$ or higher renders it possible to produce a lubricating oil composition which is sufficient in oil film formation and thus more excellent in lubricity and less in evaporation loss of the base oil under elevated temperature conditions.

No particular limitation is imposed on the viscosity index of base oil (A) used in the present invention, which is, however, preferably 80 or greater, more preferably 90 or greater, more preferably 100 or greater, particularly preferably 110 or greater. The use of a lubricating base oil with a viscosity index of 80 or greater renders it possible to produce a composition with excellent fatigue life and extreme pressure properties at an initial use and after used for a long period of time. However, the viscosity index is preferably 180 or less. This is because a base oil with a viscosity index of greater than 180 would cause the viscosity to increase rapidly at low temperatures.

Lubricating base oil (A) in the present invention may be one type of mineral base oil alone but is preferably a mixture of two more mineral base oils with the objective of imp roving extreme pressure properties.

When a mix base oil is used as lubricating base oil (A), a base oil (A1) with a 40° C. kinematic viscosity of 40 $mm^2/s$ or lower and a base oil (A2) with a 40° C. kinematic viscosity of 60 $mm^2/s$ or higher are preferably used in combination.

Mineral lubricating base oil (A1) used in the present invention is particularly preferably a base oil produced by further subjecting a base oil selected from (1) to (8) described above to the following treatments.

That is, preferred are a hydrocracked mineral base oil and/or wax-isomerized isoparaffinic base oil produced by hydrocracking or wax-isomerizing a base oil selected from (1) to (8) described above as it is or a lubricating fraction recovered therefrom and subjecting the resulting product as it is or a lubricating fraction recovered therefrom to dewaxing such as solvent dewaxing or catalytic dewaxing, followed by solvent refining or followed by solvent refining and then dewaxing such as solvent dewaxing or catalytic dewaxing.

Base oil (A1) is preferably a base oil with a 40° C. kinematic viscosity of preferably 30 $mm^2/s$ or lower, more preferably 25 $mm^2/s$ or lower. However, base oil (A1) has necessarily a 40° C. kinematic viscosity of 10 $mm^2/s$ or higher.

Base oil (A2) is preferably a base oil with a 40° C. kinematic viscosity of 70 $mm^2/s$ or higher, more preferably 80 $mm^2/s$ or higher, more preferably 90 $mm^2/s$ or higher. Larger difference in 40° C. kinematic viscosity between base oil (A1) and base oil (A2) is preferable because Component (A) would be enhanced in viscosity index. However, the mix base oil necessarily has a 40° C. kinematic viscosity of 10 $mm^2/s$ or higher and 100 $mm^2/s$ or lower.

The content of the aforesaid base oil (A1) in base oil (A) is preferably 10 percent, by mass or more, more preferably 20 percent by mass or more, more preferably 30 percent by mass or more and preferably 70 percent by mass or less, more preferably 60 percent by mass or less, more preferably 55 percent by mass or less. The use of a base oil with a content of base oil (A1) of 10 percent by mass or more enhances the viscosity index thereby improving the fuel saving properties. The content exceeding 70 percent by mass is not preferable because no enhancement in extreme pressure properties can be expected.

Component (B), i.e., base oil (high viscosity lubricating base oil) used in the present invention is a mineral base oil having a 40° C. kinematic viscosity of 200 $mm^2/s$ or higher and 600 $mm^2/s$ or lower and a sulfur content of 0.3 to 0.9 percent by mass.

The 40° C. kinematic viscosity of base oil (B) of the lubricating oil composition of the present invention is preferably 230 $mm^2/s$ or higher. The upper limit is preferably 600 $mm^2/s$ or lower, more preferably 550 $mm^2/s$ or lower, more preferably 510 $mm^2/s$ or lower.

The use of base oil (B) having a 40° C. kinematic viscosity within the above range can provide excellent fatigue life and extreme pressure properties at an initial use and after used for a long period of time. A 40° C. kinematic viscosity of lower than 200 $mm^2/s$ is not preferable because the base oil would be less effective in improving fatigue life and initial extreme pressure properties while a 40° C. kinematic viscosity of 600 $mm^2/s$ or higher is not also preferable because the viscosity of the composition at low temperatures would be too high.

The sulfur content of base oil (B) is 0.3 percent by mass or more, more preferably 0.4 percent by mass or more and 0.9 percent by mass or less, preferably 0.8 percent by mass or less, more preferably 0.7 percent by mass or less, particularly preferably 0.6 percent by mass or less. It is considered that sulfur-containing compounds in base oil (B) are contribute to an enhancement in fatigue life and when the sulfur content is 0.3 percent by mass or more, base oil (B) would be more contributive to an enhancement in extreme pressure properties. Base oil (B) having a sulfur content of more than 0.9 percent by mass is not preferable because it would be likely to deteriorate the oxidation stability of the composition.

No particular limitation is imposed on the viscosity index of base oil (B) used in the present invention, which is, however, preferably 80 or greater, more preferably 90 or greater and preferably 200 or less, more preferably 180 or less. Higher viscosity index base oil (B) has, more excellent fuel saving properties the composition has. However, a viscosity index of greater than 200 is not preferable because the viscosity adversely rises at low temperatures.

No particular limitation is imposed on the pour point of base oil (B), which is, however, preferably −10° C. or lower, more preferably −20° C. or lower, particularly preferably −30° C. or lower with the objective of not deteriorating the low temperature properties. The use of Component (B) having a viscosity index and a pour point within the above ranges renders it possible to produce a composition having excellent viscosity characteristics from low temperatures to high temperatures.

No particular limitation is imposed on the $\%C_A$ of base oil (B), which is, however, preferably 3 to 10, more preferably 5 to 9 because a composition with excellent fatigue life car be produced.

No particular limitation is imposed on the $\%C_N$ of base oil (B), which is, however, preferably 15 to 40, more preferably 20 to 30 because a composition with excellent fatigue life can be produced No particular limitation on the $\%C_P$ of base oil (B), which is, however, preferably 55 to 100, more preferably 60 to 80, more preferably 65 to 75 because a composition with excellent fatigue life can be produced Mineral lubricating base oils used as Component (B) are the same type as and produced by the same method as the mineral lubricating base oils having been described with respect to Component (A) but are preferably those produced by subjecting a feedstock of the above-described (1) to (8) to any one or more step selected from solvent refining such as furfural solvent extraction, dewaxing such as solvent dewaxing and catalytic dewaxing and hydrorefining such as hydrofinishing.

Component (B) may be one type or a mix base oil of two or more types selected from the above-described mineral lubricating base oils.

The content of the base oil belonging to Component (B) in the lubricating base oil of base oils (A) and (B) is necessarily 15 percent by mass or more, preferably 17 percent by mass or more, more preferably 20 percent by mass or more on the basis of the total mass of the composition. Whilst, the content of base oil (B) is preferably 70 percent by mass or less, more preferably 50 percent by mass or less. A content of base oil (B) of less than 15 percent by mass is not preferable in view of anti-seizure properties or anti-wear properties.

No particular limitation is imposed on the properties of the lubricating base oil comprising base oil (A) and base oil (B), which are, however, preferably ad lusted as follows with the objective of enhancing fuel saving properties and extreme pressure properties.

Particularly, when the composition is used for automobile gears, the 40° C. kinematic viscosity of the lubricating base oil comprising base oils (A) and (B) is preferably 45 $mm^2/s$ or higher, more preferably 55 $mm^2/s$ or higher, particularly preferably 65 $mm^2/s$. Whilst, the upper limit is preferably 90 $mm^2/s$ or lower, more preferably 80 $mm^2/s$, more preferably 75 $mm^2/s$, particularly preferably 70 $mm^2/s$ or lower.

The sulfur content of the lubricating base oil comprising base oils (A) and (B) is preferably 0.05 percent by mass or more, more preferably 0.1 percent by mass or more, more preferably 0.15 percent by mass or more, particularly preferably 0.2 percent by mass or more with the objective of improving extreme pressure properties. The sulfur content is preferably 0.8 percent by mass or less, more preferably 0.6 percent by mass or less, more preferably 0.4 percent by mass, particularly preferably 0.3 percent by mass or less in view of oxidation stability.

The lubricating oil composition of the present invention contains an organic molybdenum compound as Component (C).

Examples of organic molybdenum compounds used in the present invention include various organic molybdenum compounds such as (C1) sulfur-containing organic molybdenum compounds and (C1) organic molybdenum compound containing no sulfur as a structural element.

Examples of (C1) sulfur-containing organic molybdenum compounds include molybdenum dithiophosphates and molybdenum dithiocarbamates.

Examples of molybdenum dithiophosphates include compounds represented by formula (1) below:

(1)

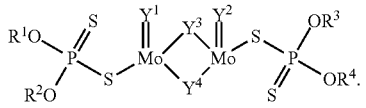

In formula (1) above, $R^1$, $R^2$, $R^3$ and $R^4$ may be the same or different from one another and an alkyl group having 2 to 30, preferably 5 to 18, more preferably 5 to 12 carbon atoms or an (alkyl)aryl group having 6 to 18, preferably 10 to 15 carbon atoms, and $Y^1$, $Y^2$, $Y^3$ and $Y^4$ are each independently sulfur or oxygen.

Examples of molybdenum dithiocarbamates include compounds represented by formula (2):

(2)

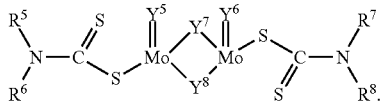

In formula (2), $R^5$, $R^6$, $R^7$ and $R^8$ may be the same or different from one another and are each a hydrocarbon group such as an alkyl group having 2 to 24, preferably 4 to 13 carbon atoms or an (alkyl)aryl group having 6 to 24, preferably 10 to 15 carbon atoms, and $Y^5$, $Y^6$, $Y^7$ and $Y^8$ are each independently sulfur or oxygen.

Examples of sulfur-containing organic molybdenum compounds other than those exemplified above include complexes of molybdenum compounds (for example, molybdenum oxides such as molybdenum dioxide and molybdenum trioxide, molybdic acids such as orthomolybdic acid, paramolybdic acid, and sulfurized (poly)molybdic acid, metal salts of these molybdic acids, molybdic acid salts such as ammonium salts of these molybdic acids, molybdenum sulfides such as molybdenum disulfide, molybdenum trisulfide, molybdenum pentasulfide, and molybdenum polysulfide, sulfurized molybdenum acid, metal and amine salts of sulfurized molybdenum acid, and halogenated molybdenum such as molybdenum chloride) and sulfur-containing organic compounds (for example, alkyl (thio)xanthate, thiaziazole, mercaptothiadiazole, thiocarbonate, tetrahydrocarbylthiuramdisulfide, bis(di(thio)hydrocarbyldithiophosphonate)disulfide, organic (poly)sulfide, and sulfurized esters) or other organic compounds; complexes of sulfur-containing molybdenum compounds such as the above-mentioned molybdenum sulfides and sulfurized molybdenum acid and amine compounds, succinimides, organic acids, or alcohols, described below with respect to the organic molybdenum compounds containing no sulfur as a constituent; and sulfur-containing organic molybdenum compounds produced by reacting sulfur sources such as elemental sulfur, hydrogen sulfide, phosphorus pentasulfide, sulfur oxide, inorganic sulfides, hydrocarbyl (poly)sulfides, sulfurized olefins, sulfurized esters, sulfurized waxes, sulfurized carboxylic acids, sulfurized alkylophenols, thioacetamide, and thiourea, molybdenum compounds containing no sulfur as a constituent described below and sulfur-free organic compounds such as amine compounds, succinimides, organic acids and alcohols described below with respect to the molybdenum compounds containing no sulfur as a constituent. More specific examples of these sulfur-containing organic molybdenum compounds include those described in Japanese Patent Laid-Open Publication No. 56-10591 and U.S. Pat. No. 4,263,152 in detail.

Specific examples of (C2) the organic molybdenum compounds containing no sulfur as a structural element include molybdenum-amine complexes, molybdenum-succinimide complexes, molybdenum salts of organic acids, and molybdenum salts of alcohols. Preferable examples include molybdenum-amine complexes, molybdenum salts of organic acids, and molybdenum salts of alcohols.

Preferably sulfur-containing organic molybdenum compounds, most preferably molybdenum dithiocarbamates are used as the organic molybdenum compound in the present invention because of their excellent friction reducing effect.

The content of Component (C), i.e., organic molybdenum compound used in the lubricating oil composition of the present invention is from 100 to 1000 ppm by mass, preferably 200 ppm by mass or more, more preferably 400 ppm by mass or more and preferably 900 ppm by mass or less, more preferably 800 ppm by mass or less, more preferably 600 ppm by mass or less as molybdenum metal on the total composition mass basis. When the content is less than 100 ppm by mass, no fuel saving effect can be expected. Whilst, when the content is more than 1000 ppm by mass, it is not preferable because the lubricating oil composition is likely to be deteriorated in stability particularly at high temperatures.

Preferably, the lubricating oil composition of the present invention further comprises a boron-containing compound as Component (D) in an amount of 100 to 300 ppm by mass as boron.

Component (D) may be a boron-containing compound which is oil-soluble.

Examples of Component (D), i.e., boron-containing compound include metallic detergents produced by overbasing metallic detergents such as alkaline earth metal sulfonates, alkaline earth metal salicylates, alkaline earth metal phenates and alkaline earth metal phosphonates with a borate such as an alkaline earth metal borate.

Examples of the alkaline earth metal sulfonates include alkaline earth metal salts, preferably magnesium and calcium salts, particularly preferably calcium salts of alkyl aromatic sulfonic acids produced by sulfonating alkyl aromatic compounds.

Examples of the alkaline earth metal salicylate include salicylates having an alkyl or alkenyl group of alkaline earth metals and/or (overbased) basic salts thereof. Examples of the alkaline earth metal include magnesium, barium, and calcium. Particularly preferred are magnesium and calcium. Preferably used are salicylates of alkaline earth metal, having one alkyl or alkenyl group per molecule and/or (overbased) basic salts thereof.

Examples of the alkaline earth metal phenate include alkaline earth metal salts, particularly magnesium, salts and/or calcium salts of an alkylphenol or alkylphenol sulfide having an alkyl or alkenyl group, and a Mannich react ion product of the alkylphenol. Particularly preferred are sulfur-free alkaline earth metal phenates. The alkyl group is preferably straight-chain.

Specific examples of the borate include alkali metal salts, alkaline earth metal salts or ammonium salts of boric acid. Examples of the boric acid referred herein include orthoboric acid, metaboric acid and tetraboric acid.

Specific examples of the metallic detergent overbased with a borate include lithium borate such as lithium metaborate, lithium tetraborate, lithium pentaborate and lithium perborate; sodium borate such as sodium, metaborate, sodium diborate, sodium tetraborate, sodium pentaborate, sodium hexaborate and sodium octaborate; potassium borate such as potassium metaborate, potassium tetraborate, potassium pentaborate, potassium hexaborate and potassium octaborate; calcium borate such as calcium metaborate, calcium diborate, tricalcium tetraborate, pentacalcium tetraborate and calcium hexaborate; magnesium borate such as magnesium metaborate, magnesium diborate, trimagnesium tetraborate, pentamagneium tetraborate and magnesium hexaborate; and ammonium borate such as ammonium methaborate, ammonium tetraborate, ammonium pentaborate and ammonium octaborate Examples of other additives that can be used as Component (D) in the present invention include boric acid esters of compounds having a hydroxyl group such as alcohols and diols. The compounds having a hydroxyl group have a hydrocarbon group of 6 or more, preferably 12 or more carbon atoms to ensure the oil solubility.

Further examples of other additives that can be used as Component (D) in the present invention include any boronated ashless dispersant. In the present invention, the boronated ashless dispersants as Component (D) are most preferably used a boron source.

Examples of the ashless dispersant include the following nitrogen compounds, one or more of which may be used:

(D1) succinimides having at least one straight-chain or branched alkyl or alkenyl group having 40 to 400 carbon atoms per molecule or derivatives thereof;

(D2) benzylamines having at least one straight-chain or branched alkyl or alkenyl group having 40 to 400 carbon atoms per molecule or derivatives thereof; and (D3) polyamines at least one straight-chain or branched alkyl or alkenyl group having 40 to 400 carbon atoms per molecule or derivatives thereof.

The carbon number of the alkyl or alkenyl group of the ashless dispersant is preferably 40 to 400, more preferably 60 to 350. If the carbon number of the alkyl or alkenyl group is fewer than 40, the compound would tend to be degraded in solubility in the lubricating base oil. Whereas, if the carbon number of the alkyl or alkenyl group is more than 400, the resulting lubricating oil composition would be degraded in low-temperature fluidity. The alkyl or alkenyl group may be straight-chain or branched but is preferably a branched alkyl or alkenyl group derived from oligomers of olefins such as propylene, 1-butene or isobutylene or a cooligomer of ethylene and propylene.

Specific examples of (D1) succinimides include compounds represented by formulas (3) and (4):

(3)

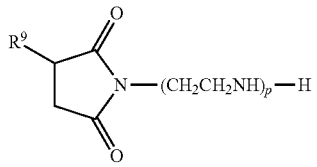

(4)

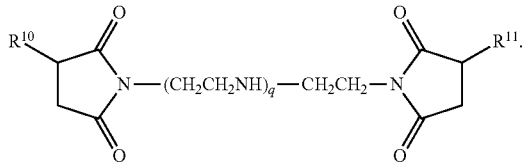

In formula (3), $R^9$ is an alkyl or alkenyl group having 40 to 400, preferably 60 to 350, and p is an integer of 1 to 5, preferably 2 to 4.

In formula (4), $R^{10}$ and $R^{11}$ are each independently an alkyl or alkenyl group having 40 to 400, preferably 60 to 350, and q is an integer of 0 to 4, preferably 1 to 3.

Succinimides include mono-type succinimides wherein a succinic anhydride is added to one end of a polyamine, as represented by formula (3) and bis-type succinimides wherein a succinic anhydride is added to both ends of a polyamine, as represented by formula (4), The lubricating oil composition may contain either type of the succinimides or a mixture thereof.

No particular limitation is imposed on the method for producing the succinimide, for example, a method may be used, wherein an alkyl or alkenyl succinimide produced by reacting a compound having an alkyl or alkenyl group having 40 to 400 carbon atoms with maleic anhydride at a temperature of 100 to 200° C. is reacted, with a polyamine. Examples of the polyamine include diethylene triamine, tri ethylene tetramine, tetraethylene pentamine, and pentaethylene hexamine.

Specific examples of (D2) benzylamines include compounds represented by formula (5):

(5)

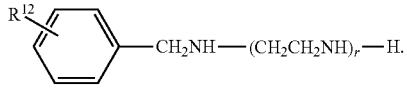

In formula (5), $R^{12}$ is an alkyl or alkenyl group having 40 to 400, preferably 60 to 350 and r is an integer of 1 to 5, preferably 2 to 4.

No particular limitation is imposed on the method for producing the benzylamines. They may be produced by reacting a polyolefin such as a propylene oligomer, polybutene, or ethylene-α-olefin copolymer with a phenol so as to produce an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of (D3) polyamines include compounds represented by formula (6):

$$R^{13}—NH—(CH_2CH_2NH)_k—H \quad (6)$$

In formula (6), $R^{13}$ is an alkyl or alkenyl group having 40 to 400, preferably 60 to 350 and k is an integer of 1 to 5, preferably 2 to 4.

No particular limitation is imposed on the method for producing the polyamines. For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, and pentaethylenehexamine.

Boronation is generally carried out by allowing succinimide to react with boric acid to neutralize the whole or part of the remaining amino and/or imino groups.

Examples of a method of producing a boronated succinimide are those disclosed in Japanese Patent Publication Nos. 42-8013 and 42-8014 and Japanese Patent Application Laid-Open Publication Nos. 51-52381 and 51-130408. More specifically, a boronated succinimide may be produced by mixing polyamine and polybutenylsuccinic acid (anhydride) with a boron compound such as boric acid, a boric acid ester, or a borate in a solvent including alcohols, organic solvent such as hexane or xylene, or a light tract ion lubricating base oil and by heating the mixture under appropriate conditions. The boron content of the boron acid-modified succinimide produced in this manner may be usually from 0.1 to 4.0 percent by mass.

The molecular weight of the hydrocarbon group of the boric acid-modified succinimide is preferably 1000 or greater, more preferably 1500 or greater, more preferably 2000 or greater. The molecular weight is preferably 5000 or less, more preferably 4000 or less. If the molecular weight is less than 1000, the resulting composition would be high in friction coefficient and thus less effective in fuel saving. Whilst, the molecular weight exceeds 5000, it would be difficult to synthesize the boric acid-modified succinimide.

The boron content of the composition of the present invention is preferably 100 ppm by mass or more, more preferably 150 ppm by mass or more and preferably 300 ppm by mass or less, more preferably 280 ppm by mass or less, more preferably 250 ppm by mass or less, most preferably 220 ppm by mass or less on the total composition mass basis. A composition with a boron content of less than 100 ppm by mass would be poor in extreme pressure properties while a composition with a boron content of more than 300 ppm by mass would be deteriorated in extreme pressure properties due to adverse effects by additives.

Since the composition of the present invention is used in a gear system of an automobile, the composition preferably comprises (E) an extreme pressure additive containing a blend of a sulfur compound and a phosphorus compound. Specifically, commercially available additive packages may be used. Examples of such packages include LZ Anglamol 6043 manufactured by The Lubrizol Corporation and Hitec 3434 manufactured by Afton Chemical Corporation. The extreme pressure additive may be added in accordance with a recommended amount depending on the type of gears or driving conditions.

In the present invention, blending a lubricating base oil comprising base oil (A) and base oil (B) with the above-described Component (C) or furthermore Component (D) and/or Component (E) in specific amounts renders it possible to produce a lubricating oil composition for gear systems with excellent extreme pressure properties, low temperature viscosity characteristics and oxidation stability. However, tire composition may further contain conventional lubricating oil additives such as ashless dispersants or metallic detergents other than Component (D), friction modifiers, extreme pressure additives and antiwear agents other than Component (E), rust inhibitors, corrosion inhibitors, viscosity index improvers, pour point depressants, rubber swelling agents, anti-foaming agents and colorants alone or in combination in order to further enhance various properties of the composition.

Examples of ashless dispersants other than Component (D) that may be used in combination with the lubricating oil composition of the present invention include ashless dispersants that are those prior to boronation carried out to produce boronated ashless dispersants.

Specific examples of nitrogen-containing compound derivatives exemplified as an ashless dispersant include acid-modified compounds produced by allowing any of the above-described nitrogen-containing compounds to react with a monocarboxylic acid having 2 to 30 carbon atoms (fatty acid) or a polycarboxylic acid having 2 to 30 carbon atoms, such as oxalic acid, phthalic acid, trimellitic acid, and pyromellitic acid, so as to neutralize or amidize the whole or part of the remaining amino and/or imino groups; sulfur modified-compounds produced by allowing any of the above-described nitrogen-containing compounds to react with a sulfur compound; and modified products produced by a combination of two or more selected from the modifications with acid and sulfur, of the above-described nitrogen-containing compounds.

Metallic detergents other than Component (D) that may be used in combination with the lubricating oil composition may be any compounds that are generally used as metallic detergents for lubricating oils. Examples of such metallic detergent include alkali metal or alkaline earth metal sulfonates, alkali metal or alkaline earth metal phenates, alkali metal or alkaline earth metal salicylates, and alkali metal or alkaline earth metal naphthenates. These metallic detergents may be used alone or in combination. Preferred alkali metals include sodium and potassium, while preferred alkaline earth metals include calcium. The base number and content of these metallic detergents may be arbitrarily selected depending on the properties of a lubricating oil to be required.

Examples of friction modifiers include ashless friction modifiers such as aliphatic monohydric alcohols, fatty acids or derivatives thereof, and a liphatic amines or derivatives thereof, each having at least one alkyl or alkenyl group having 6 to 30 carbon atoms, excluding Component (C) that is the organic molybdenum compound such as molybdenum dithiophosphate and molybdenum dithiocarbamate.

Examples of extreme pressure additives and anti-wear agents other than Component (E) include disulfides, sulfurized olefins, sulfurized fats and oils, phosphorus acid ester, acidic phosphoric acid ester, amine salts of acidic phosphorus acid ester compounds and derivatives of various phosphorus compounds although some of them are used as Component (E).

Examples of rust inhibitors include alkenyl succinic acid, alkenyl succinic acid esters, polyhydric alcohol esters, petroleum sulfonates, and dinonylnaphthalene sulfonates.

Examples of the corrosion inhibitor include benzotriazole-, tolytriazole-, thiadiazole-, and imidazole-types compounds.

Examples of viscosity index improvers include polymethacrylates, olefin copolymers such as ethylene-propylene copolymers or hydrides thereof, styrene-diene copolymers, graft copolymers of polymethcrylates and olefin copolymers or hydrogenated compounds thereof.

Examples of anti-foaming agents include silicones such, as dimethylsilicone and fluorosilicone.

Although the contents of these additives are arbitrarily selected, the content of the anti-foaming agent is generally from 0.0005 to 1 percent by mass, the content of the corrosion inhibitor is generally from 0.005 to 1 percent by mass, and the content of each of the other additives is generally from 0.05 to 15 percent by mass, all on the basis of the total mass of the composition.

The 40° C. kinematic viscosity of the lubricating oil composition of the present invention is 90 $mm^2/s$ or lower, preferably 80 $mm^2/s$ or lower, more preferably 75 $mm^2/s$ or lower. Whilst, the 40° C. kinematic viscosity is preferably 20 $mm^2/s$ or higher, more preferably 40 $mm^2/s$ or higher, more preferably 50 $mm^2/s$ or higher, most preferably 60 $mm^2/s$ or higher.

The lubricating oil composition of the present invention having a 40° C. kinematic viscosity of 20 $mm^2/s$ or higher is more excellent in oil film forming capability and extreme pressure properties. Whilst, the composition having a 40° C. kinematic viscosity of 90 $mm^2/s$ or lower is less in friction resistance (friction loss) at lubricating sites and stirring resistance due to its reduced fluid resistance, resulting in a lubricating oil composition with excellent fuel saving properties.

EXAMPLES

Hereinafter, the present invention will be described in more detail by way of the following examples and comparative examples, which should not be construed as limiting the scope of the invention.

Examples 1 to 6 and Comparative Examples 1 to 8

Various lubricating base oils and additives set forth in Table 1 were blended to prepare lubricating oil compositions according to the present invention (Examples 1 to 6 in Table 1) and Lubricating oil compositions for comparison (Comparative Examples 1 to 8). The content of each additive is on the basis of the total mass of the composition.

Each of the compositions were evaluated with the total following tests.

(1) Four-Ball Extreme Pressure Test

The extreme pressure property test was carried out using a Shell four-ball testing machine in accordance with ASTM D 2783 "Standard Test Method for Measurement of Extreme-Pressure Property of Lubricating Fluids (Four-Ball Method)". One steel ball was fixed on the rotating axis and three steel balls were placed in the vessel such that all the four balls contact with each other. The vessel was filled with a sample oil. A load was applied to the three balls by pressing the ball on the rotation axis while the axis was held stationary. Thereafter, the rotation axis was rotated at a speed of 1,760±40 rpm for 10 seconds and the load was increased until welding occurs so as to obtain the last non-seizure load which is the last load at which the measured scar diameter is not more than 105 percent above the compensation scar diameter at the load. A sample having a higher last non-seizure load was evaluated as excellent in extreme pressure properties.

(2) Wear Scar Diameter

The wear scar diameter test was carried out using a Shell four-ball testing machine in accordance with ASTM D 4172 "Standard Test Method for Wear Preventive Characteristics of Lubricating Fluid (Four-Ball Method)". One steel ball was fixed on the rotating axis and three steel balls were placed in the vessel such, that all the four balls contact with each other. The vessel was filled with a sample oil. A load (392 N) was applied to the three balls by pressing the ball on the rotation axis while the axis was held stationary. Thereafter, the rotation axis was rotated at a speed of 1,200 rpm for 30 minutes at an oil temperature of 80° C. After the test, the diameters of wear scars on the contact points were measured to evaluate the anti-wear properties. The smaller the wear scar diameters, the better anti-wear properties the sample had.

(3) Farlex Seizure Test

The seizure test was carried out using a Falex style friction test machine in accordance with ASTM D 3233 "Standard Test. Methods for Measurement of Extreme Pressure Properties of Fluid Lubricants (Falex Pin and Vee Block Methods)". A steel pin was placed between a pair of V-shaped steel blocks. The vessel was filled with a sample oil. A load is applied to the pin while the rotation axis was held stationary. The load was continuously increased at a speed of 290 rpm at an oil temperature of 110° C. to determine the seizure load. The larger the seizure load, the better extreme pressure properties the sample had.

(4) SRV Test (Friction Coefficient)

The friction coefficient test; was carried out using an SRV test machine in accordance with DIN 51834-2 "Standard test method for measuring the friction and wear properties of lubricating oils using the SRV test ma chine". A steel ball is vertically fixed on a steel, plate, on which a few droplets of a sample were poured. A load (30 N) was applied to the oscillation axis while it was held stationary. The oscillation axis was then moved reciprocally (oscillated) at a stroke amplitude of 1000 μm and frequency of 50 Hz for 10 minutes while the sample oil was kept at a temperature of 60° C., The oil temperature was increased by 10° C. every 10 minutes to determine the average friction coefficient value at a temperature of 100° C. As the sample had a smaller friction coefficient it was evaluated excellent.

TABLE 1

| | | | Example 1 | Example 2 | Example 3 | Example 4 | Example 5 | Example 6 | Comparative Example 1 | Comparative Example 2 |
|---|---|---|---|---|---|---|---|---|---|---|
| Base oil A-1 | (A) | mass % | (79) | (79) | (79) | | | (72) | (79) | (79) |
| Base oil A-2 | (A2) | mass % | | | | (20) | (10) | | | |
| Base oil A-3 | (A3) | mass % | | | | (38) | (50) | | | |
| (A) base oil kinematic | (40° C.) | $mm^2/s$ | 49.06 | 49.06 | 49.06 | 31.55 | 24.47 | 49.06 | 49.06 | 49.06 |
| viscosity | (100° C.) | $mm^2/s$ | 6.923 | 6.923 | 6.923 | 5.648 | 4.844 | 6.923 | 6.923 | 6.923 |
| | VI | | 96 | 96 | 96 | 119 | 122 | 96 | 96 | 96 |
| Base oil B-1 | | mass % | (21) | (21) | (21) | | (40) | | (21) | (21) |
| Base oil B-2 | | mass % | | | | (42) | | (28) | | |
| (B) base oil kinematic | (40° C.) | $mm^2/s$ | 506.8 | 506.8 | 506.8 | 242.7 | 506.8 | 242.7 | 506.8 | 506.8 |
| viscosity | (100° C.) | $mm^2/s$ | 32.3 | 32.3 | 32.3 | 20.5 | 32.3 | 20.5 | 32.3 | 32.3 |
| | VI | | 95 | 95 | 95 | 89 | 95 | 99 | 95 | 95 |
| Base oil kinematic | (40° C.) | $mm^2/s$ | 73.66 | 73.66 | 73.66 | 66.65 | 65.64 | 72.87 | 73.66 | 73.66 |
| viscosity | (100° C.) | $mm^2/s$ | 9.03 | 90.3 | 90.3 | 9.07 | 9.01 | 9.03 | 9.03 | 9.03 |
| | VI | | 96 | 96 | 96 | 112 | 113 | 97 | 96 | 96 |
| Base oil sulfur content | | % | 0.199 | 0.199 | 0.199 | 0.355 | 0.226 | 0.26 | 0.199 | 0.199 |
| Additive composition (total composition mass basis) | | | | | | | | | | |
| Organic molybdenum compound F-1 | | mass % | 0.2 | 0.5 | 1.0 | 0.2 | 0.2 | 0.2 | | 1.2 |
| Boron-containing dispersant G-1 | | mass % | 1.0 | 1.0 | 1.0 | 1.0 | 1.0 | 1.0 | 1.0 | 1.0 |
| Non-boron dispersant H-1 | | mass % | | | | | | | | |
| Performance additive C-1 | | mass % | 6 | 6 | 6 | 6 | 6 | 6 | 6 | 6 |
| Pour point depressant D-1 | | mass % | 0.3 | 0.3 | 0.3 | 0.3 | 0.3 | 0.3 | 0.3 | 0.3 |
| Molybdenum content (as molybdenum) | | mass % | 200 | 500 | 1000 | 200 | 200 | 200 | 0 | 1200 |
| Boron content (as boron) | | mass % | 200 | 200 | 200 | 200 | 200 | 200 | 200 | 200 |
| Kinematic viscosity | (40° C.) | $mm^2/s$ | 71.5 | 71.4 | 71.6 | 65.2 | 64.3 | 71.2 | 71.3 | 71.5 |

TABLE 1-continued

| | | | | | | | | | | |
|---|---|---|---|---|---|---|---|---|---|---|
| Four ball extreme pressure test 1800 rpm | LNSL | N | 785 | 981 | 1236 | 981 | 785 | 785 | 785 | 1236 |
| Wear scar diameter | | mm | 0.51 | 0.5 | 0.45 | 0.54 | 0.51 | 0.53 | 0.55 | 0.52 |
| Falex seizure test | | lb | 2740 | 2740 | 2740 | 2740 | 2740 | 2740 | 2740 | 2140 |
| SRV test (friction coefficient) | | 100° C. | 0.105 | 0.1 | 0.092 | 0.11 | 0.106 | 0.108 | 0.155 | 0.122 |

| | | | Comparative Example 3 | Comparative Example 4 | Comparative Example 5 | Comparative Example 6 | Comparative Example 7 | Comparative Example 8 |
|---|---|---|---|---|---|---|---|---|
| Base oil A-1 | (A) | mass % | (79) | (79) | (40) | | (59) | (59) |
| Base oil A-2 | (A2) | mass % | | | (60) | (83) | (31) | (31) |
| Base oil A-3 | (A3) | mass % | | | | (17) | | |
| (A) base oil kinematic viscosity | (40° C.) | $mm^2/s$ | 49.06 | 49.06 | 72.11 | 69.41 | 60.77 | 60.77 |
| | (100° C.) | $mm^2/s$ | 6.923 | 6.923 | 9.01 | 9.048 | 8.013 | 8.013 |
| | VI | | 96 | 96 | 98 | 105 | 97 | 97 |
| Base oil B-1 | | mass % | (21) | (21) | | | (10) | (10) |
| Base oil B-2 | | mass % | | | | | | |
| (B) base oil kinematic viscosity | (40° C.) | $mm^2/s$ | 506.8 | 506.8 | | | 506.8 | 506.8 |
| | (100° C.) | $mm^2/s$ | 32.3 | 32.3 | | | 32.3 | 32.3 |
| | VI | | 95 | 95 | | | 95 | 95 |
| Base oil kinematic viscosity | (40° C.) | $mm^2/s$ | 73.66 | 73.66 | 72.11 | 69.41 | 72.63 | 72.63 |
| | (100° C.) | $mm^2/s$ | 9.03 | 9.03 | 9.01 | 9.05 | 9 | 9 |
| | VI | | 96 | 96 | 98 | 105 | 97 | 97 |
| Base oil sulfur content | | % | 0.199 | 0.199 | 0.404 | 0.4814 | 0.3044 | 0.3044 |
| Additive composition (total composition mass basis) | | | | | | | | |
| Organic molybdenum compound F-1 | | mass % | 0.2 | 0.2 | 0.2 | 0.2 | 0.2 | 0.2 |
| Boron-containing dispersant G-1 | | mass % | 0.2 | 2.0 | 1.0 | 1.0 | 1.0 | — |
| Non-boron dispersant H-1 | | mass % | | | | | | 1.0 |
| Performance additive C-1 | | mass % | 6.0 | 6.0 | 6.0 | 6.0 | 6.0 | 6.0 |
| Pour point depressant D-1 | | mass % | 0.3 | 0.3 | 0.3 | 0.3 | 0.3 | 0.3 |
| Molybdenum content (as molybdenum) | | mass % | 200 | 200 | 200 | 200 | 200 | 200 |
| Boron content (as boron) | | mass % | 40 | 400 | 200 | 200 | 200 | 0 |
| Kinematic viscosity | (40° C.) | $mm^2/s$ | 71.1 | 71.8 | 70.4 | 67.5 | 70 | 70 |
| Four ball extreme pressure test 1800 rpm | LNSL | N | 618 | 785 | 618 | 618 | 618 | 618 |
| Wear scar diameter | | mm | 0.62 | 0.55 | 0.73 | 0.8 | 0.62 | 0.74 |
| Falex seizure test | | lb | 1770 | 2370 | 2110 | 1740 | 2370 | 1980 |
| SRV test (friction coefficient) | | 100° C. | 0.124 | 0.131 | 0.137 | 0.135 | 0.112 | 0.121 |

The matters set forth in Table 1 are as follows:

Base oil A-1: solvent-refined mineral oil (GpI), Mz 20H (40° C.: 49.06 $mm^2/s$, 100° C.: 6.923 $mm^2/s$, VI: 96, sulfur content: 0.14 percent by mass, $\%C_A$: 7.75, $\%C_N$: 27.5, $\%C_P$: 64.7)

Base oil A-2: solvent-refined mineral oil (GpI), TK3095 (40° C.: 95.1 $mm^2/s$, 100° C.: 10.9 $mm^2/s$, VI: 98, sulfur content: 0.58 percent by mass, $\%C_a$: 0.6, $\%C_N$: 36.1, $\%C_F$: 63.3)

Base oil A-3: hydrorefined mineral oil (GpIII), YUBASE4 (40° C.: 19.57 $mm^2/s$, 100° C.: 4.23 $mm^2/s$, VI: 122, sulfur content: <10 ppm by mass, $\%C_P$: 80.7, $\%C_N$: 19.3, $\%C_A$: 0)

Base oil B-1: solvent-refined base oil (GpI), Mz 150BS (40° C.: 506.8 $mm^2/s$, 100° C.: 32.30 $mm^2/s$, VI: 95, sulfur content; 0.42 percent: by mass, $\%C_A$: 8.23, $\%C_N$: 24.6, $\%C_P$: 67.2)

Base oil B-2: solvent-refined base oil (GpI), TK5095 (40° C.: 242.7 $mm^2/s$, 100° C.: 20.5 $mm^2/s$, VI: 99, sulfur content: 0.57 percent by mass, $\%C_A$: 5.9, $\%C_H$: 23.9, $\%C_P$: 70.2)

Organic molybdenum compound F-1: MoDTC (Mo: 10.0 percent by mass)

Boron-containing dispersant G-1: boronated succinimide (B: 2.0 percent by mass, N: 2.3 percent by mass, Mw: 1000)

Non-boron dispersant H-1: non-boronated succinimide (E: 0.0 percent by in as, N: 2.1 percent by mass, Mw: 1000)

Performance additive C-1: GL-5PKG, (P: 1.40 percent by mass, S: 22.9 percent by mass)

Pour point depressants D-1: alkylmethacrylate copolymer

Wear scar diameter: 392N, 1200 rpm, 80° C., 30 min

Falex Seizure test: 290 rpm, 110° C.

SRV test: Ball-Disk, load (30 N), test distance (1000 μm), stroke amplitude (50 Hz), oil temperature (100° C.)

INDUSTRIAL APPLICABILITY

The lubricating oil composition of the present invention is a lubricating oil composition having fuel saving properties and providing gears and bearings with satisfactory durability, which is thus suitably used particularly for a gear system of an automobile. Therefore, for example, the use of the composition for automobiles automatic transmissions, continuously variable transmission, manual transmissions or particularly final reduction gears can reduces the stir resistance and frictional resistance at the gear bearing mechanism and in the oil pump thus enhances the power transmission efficiency, resulting in an improvement in the fuel efficiency of an automobile.

The invention claimed is:

1. A lubricating oil composition comprising a lubricating base oil comprising a mix base oil of (A) a mineral base oil having a 40° C. kinematic viscosity of 10 $mm^2/s$ or higher and 100 $mm^2/s$ or lower and (B) a mineral base oil having a 40° C. kinematic viscosity of 200 $mm^2/s$ or higher and 600 $mm^2/s$ or lower and a sulfur content of 0.3 to 0.9 percent by mass, the content of the base oil belonging to Component (B) is 15 percent by mass or more, and (C) an organic molybdenum compound in an amount of 100 to 1000 ppm by mass as molybdenum, the lubricating oil composition having a 40° C. kinematic viscosity of 50 $mm^2/s$ or higher and 90 $mm^2/s$ or lower.

2. The lubricating oil composition according to claim 1 further comprising (D) a boron-containing compound in an amount of 100 to 300 ppm by mass as boron.

3. The lubricating oil composition according to claim 2 wherein (D) the boron-containing compound is a metallic detergent overbased with a borate or a boronated ashless dispersant.

4. A method for lubricating an automobile gear system using a lubricating oil composition comprising a lubricating base oil comprising a mix base oil of (A) a mineral base oil having a 40° C. kinematic viscosity of 10 $mm^2/s$ or higher and 100 $mm^2/s$ or lower and (B) a mineral base oil having a 40° C. kinematic viscosity of 200 $mm^2/s$ or higher and 600 $mm^2/s$ or lower and a sulfur content of 0.3 to 0.9 percent by mass, the content of the base oil belonging to Component (B) is 15 percent by mass or more, and (C) and an organic molybdenum compound in an amount of 100 to 1000 ppm by mass as molybdenum, the lubricating oil composition having a 40° C. kinematic viscosity of 50 $mm^2/s$ or higher and 90 $mm^2/s$ or lower.

* * * * *